US005711230A

United States Patent [19]

Parsons

[11] Patent Number: 5,711,230

[45] Date of Patent: Jan. 27, 1998

[54] PLATFORM SYSTEM

[75] Inventor: Philip Lee Parsons, London, United Kingdom

[73] Assignee: P. L. Parsons & Company Ltd., United Kingdom

[21] Appl. No.: 448,443

[22] PCT Filed: Dec. 3, 1993

[86] PCT No.: PCT/GB93/02489

§ 371 Date: Jul. 24, 1995

§ 102(e) Date: Jul. 24, 1995

[87] PCT Pub. No.: WO94/13907

PCT Pub. Date: Jun. 23, 1994

[30] Foreign Application Priority Data

Dec. 4, 1992 [GB] United Kingdom ..... 9225460

[51] Int. Cl.[6] ..... A47B 3/00

[52] U.S. Cl. ..... 108/186; 108/153; 52/7

[58] Field of Search ..... 108/180, 192, 108/193, 186, 153, 152; 52/7, 263, 79.1

[56] References Cited

U.S. PATENT DOCUMENTS

| | | | |
|---|---|---|---|
| 3,255,721 | 6/1966 | Peterschmidt | 108/186 |
| 3,533,363 | 10/1970 | Reiss | 108/153 |
| 3,749,343 | 7/1973 | Marschak | 108/192 X |
| 3,851,601 | 12/1974 | Davis | 108/192 X |
| 4,242,969 | 1/1981 | Checkwood et al. | 108/153 |
| 4,585,365 | 4/1986 | Manno | 108/153 X |
| 4,630,550 | 12/1986 | Weitzman | 108/186 X |
| 4,813,201 | 3/1989 | Parsons et al. . | |

FOREIGN PATENT DOCUMENTS

| | | | |
|---|---|---|---|
| 2478450 | 9/1981 | France | 108/180 |
| 0147308 | 12/1984 | France . | |
| 3331192 | 3/1985 | Germany | 108/153 |
| 1054411 | 1/1964 | United Kingdom . | |
| 1011688 | 12/1965 | United Kingdom | 108/153 |
| 1203261 | 6/1982 | United Kingdom . | |
| 2185272 | 12/1985 | United Kingdom . | |
| 2226060 | 11/1989 | United Kingdom . | |

*Primary Examiner*—Jose V. Chen

*Attorney, Agent, or Firm*—Ostrolenk, Faber, Gerb & Soffen, LLP

[57] ABSTRACT

A platform system including at least one unit comprising a substantially flat platform. Each of the units has hollow corner posts from which supporting legs extend downwardly. Each of the corner posts includes at least one lug integrally cast or molded with the corner post. The lug extending from the corner post provides connection of the corner post to a side frame which supports the platform above. The provision of the lugs on the corner post provide for the assembly of the platform system in a secure manner at the site of the platform system.

8 Claims, 1 Drawing Sheet

PLATFORM SYSTEM

BACKGROUND OF THE INVENTION

1. Field of the Invention

This invention relates to a platform system, in particular for staging units. Such units are commonly used in the entertainment industry (theaters, studios, concert halls, etc.). The platform system of the invention may however find wider application, particularly in the building industry.

2. Description of the Prior Art

The present invention is particularly concerned with a platform system of the general type described in U.S. Pat. No. 4,813,201, according to which at least one unit each comprises a substantially flat platform having on the underside thereof downwardly extending hollow posts of square cross-section, and legs of circular cross-section insertable into said posts to provide a platform of variable height and angle of rake.

In the known platform system of this type the side frame elements, which may be of conventional truss design, are welded to the corner posts, as a result of which the platform has a high packing volume. Also, in the known system, it is necessary to weld the side frame to the corner posts with considerably accuracy. It would therefore be desirable to provide a platform system wherein the various components thereof could be readily assembled on site, possibly by selection from components of different sizes.

SUMMARY OF THE INVENTION

The present invention is therefore concerned with an improvement of the corner post construction and its manner of connection to the main part of the frame of the platform system.

The present invention provides a platform system comprising at least one unit each comprising a substantially flat platform having on the underside thereof downwardly extending hollow posts, and legs insertable into the said posts, which posts are cast or moulded and each include one or more lugs designed to be connected with the side frame of the platform.

In the platform system of the invention the components thereof can be readily assembled on site, and a strong connection between the corner posts and the side frame can be obtained with good accuracy.

The lugs which are integral with the corner posts are suitably connectable to the side frame by rivets or the like, the connection between the lugs and the side frame being preferably reinforced by adhesive. However, the corner posts may be welded or bonded to the side frame, if desired.

The corner posts will be preferably each provided with an integral nut, threaded boss, or the like screwthreaded portion for cooperating with a screw or bolt for fixing the supporting legs into the posts. As in the platform system of U.S. Pat. No. 4,813,201, the posts are preferably of square cross-section and the legs are of circular cross-section. Tightening the screw or bolt into the thread in the nut or boss on the corner post drives the leg against the two opposing inner faces of the post. The legs are preferably of scaffold tube inserted into the posts to provide staging of variable height or angle of rake.

The cast or moulded corner posts can be provided at their upper ends with flanges to receive and retain the corners of the flat top of the platform. The flat platform top is usually a sheet of wood.

The invention in another aspect provides a cast or moulded corner post for use in the platform system of the invention, the post having at least one lug integral therewith for connection to a side frame member of the platform.

BRIEF DESCRIPTION OF THE DRAWINGS

The invention will be further described, by way of example only, with reference to the accompanying drawings, in which.

Figure 1:
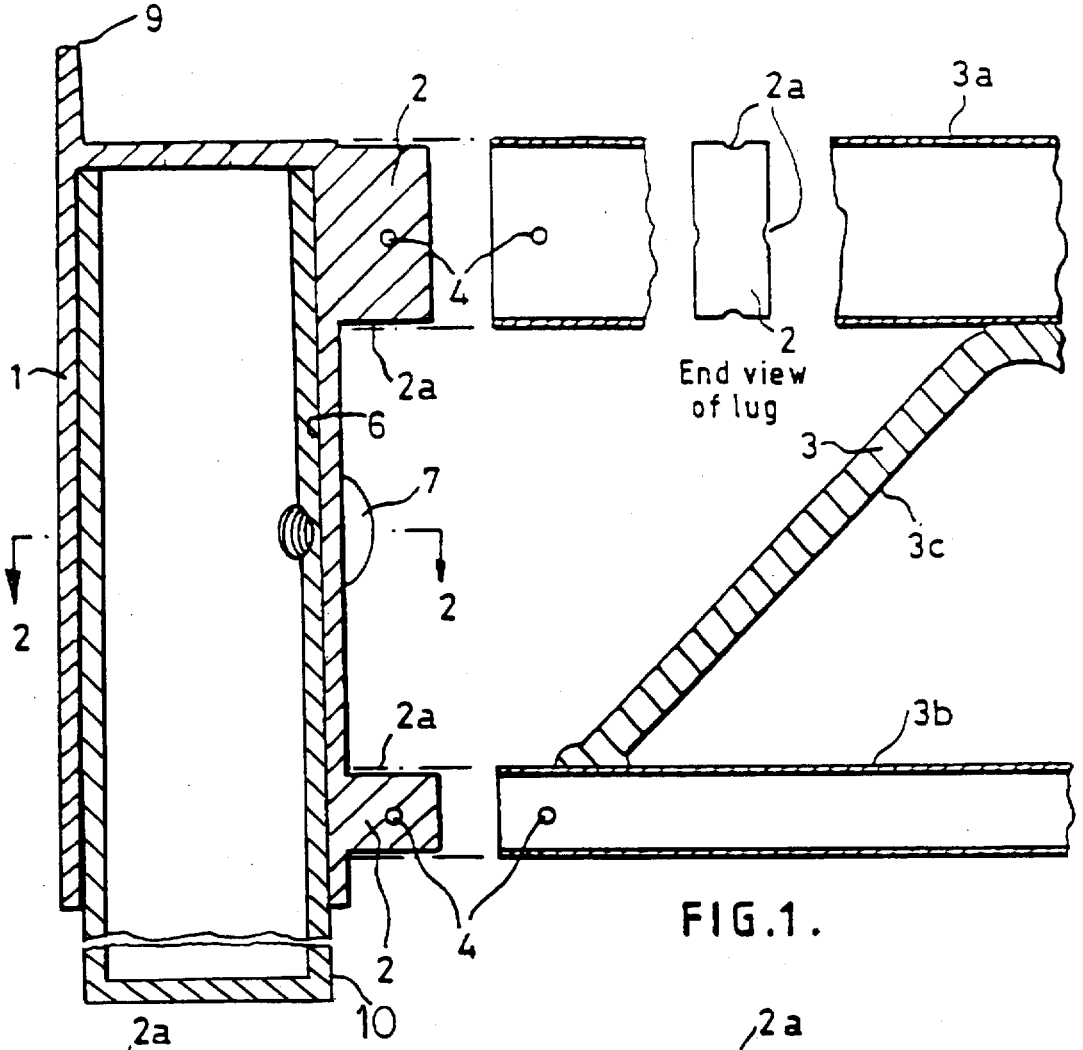
FIG. 1 is a side sectional view of a corner post and adjacent part of a typical side frame of a platform system according to the invention.
Figure 3:
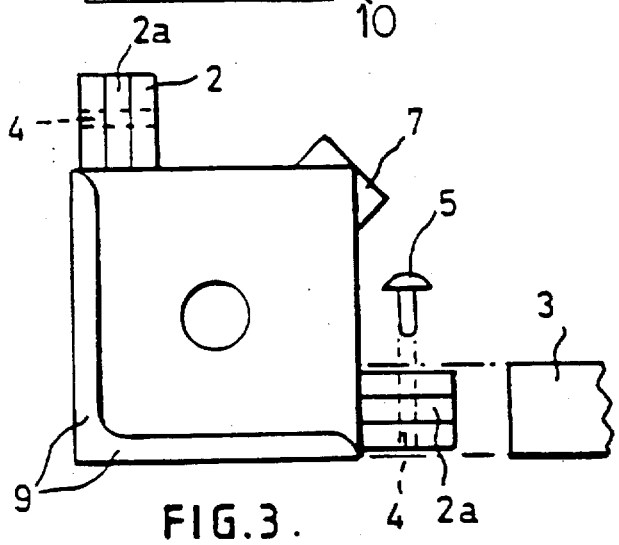
FIG. 3 is top elevation of the corner post shown in FIG. 1.

The drawings show a corner post and adjacent side frame of a platform system which is generally of the type described in U.S. Pat. No. 4,813,201.

DESCRIPTION OF THE PREFERRED EMBODIMENT

Referring to the Figures, the corner post 1 is cast from metal, e.g. steel or aluminium, or moulded (e.g. injection moulded) from plastics material, in a single piece, and has lugs 2 for connecting the post to a side frame 3 of the platform system. The side frame 3 is, for example, of truss design and comprises upper and lower tubular parts 3*a* and 3*b* connected by an undulating tubular part 3*c* welded to the parts 3*a* and 3*b*.

Tubular supporting legs 10 are inserted into the corner posts 1. The corner posts 1 are of square cross-section and the supporting legs 10 are of circular cross-section.

The lugs and the side frame parts 3*a* and 3*b* have holes 4 for receiving rivets 5 or the like for securing them together. The side frame parts 3*a* and 3*b* have inner dimensions adapted to fit over the outer dimensions of the lugs 2. The lugs are also provided with longitudinal channels 2*a* for adhesive. The rivets 5 or the like will normally be fitted during curing of the applied adhesive. Adhesive may in use be injected into one of the holes 4, from which it will flow into the channels 2*a*.

The internal wall 6 of the post 1 is tapered as shown facilitate removal of the post from a mould.

The post 1 is also provided with an integral nut or boss 7 for receiving a screw or bolt (not shown) for securing a tubular supporting leg 10 within a corner post 1. The boss 7 has a thread tapped after casting or moulding, as shown in FIG. 2.

Figure 2:
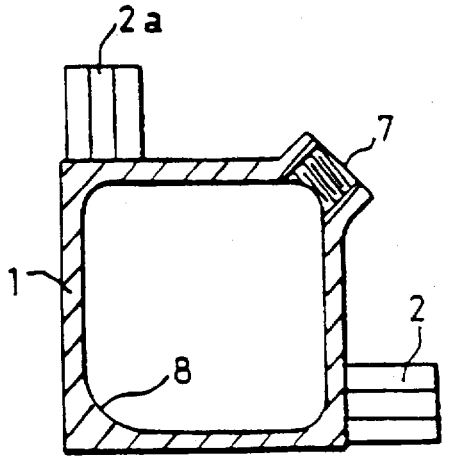
FIG. 2 in a section taken along the line X—X in FIG. 1.

As best shown in FIG. 2, extra material may be provided at the intended external corner 8 of the corner post 1, for additional strength.

The top face of the corner post 1 is provided with a flange 9 on two sides as shown, to form a corner for receiving and retaining a corner of a flat top of the platform (not shown).

As previously explained, the component parts of the platform system of the Invention, in particular the corner posts 1 and the side frame 3, may be securely and readily connected together on site, by virtue of the posts 1 which are pre-cast or moulded and provided with the lugs 2.

I claim:

1. A platform system suitable for providing staging, said system comprising: at least one unit that includes a substantially flat platform having a side frame, downwardly extending hollow corner posts located on the underside of said platform, and supporting legs inserted into the corner posts, at least two lugs being integrally formed with each respective corner post, one of said lugs being connected with an upper mating part of the side frame of the platform and another of said lugs being connected with a lower mating part of the side frame, said hollow corner posts extending downward below said one lug.

2. A platform system according to claim 1, wherein the lugs and the side frame have holes for receiving rivets or the like for securing the corner posts and side frame together.

3. A platform system according to claim 1, wherein the corner posts are welded or bonded to the side frame.

4. A platform system according to claim 1, wherein the lugs are provided with longitudinal channels for adhesive for reinforcing a connection between the lugs and the side frame.

5. A platform system according to claim 1, wherein the corner posts are each provided with a threaded portion for cooperating with a screw or bolt for fixing the supporting legs in the corner posts.

6. A platform system according to claim 1, wherein the corner posts are of square cross-section and the supporting legs are of circular cross-section.

7. A platform system according to claim 1, wherein the corner posts are provided at their upper ends with flanges to receive and retain corners of a flat top of the platform.

8. A platform system according to claim 1, wherein said corner post and its at least two integral lug are either cast or moulded.

* * * * *